US006599226B2

(12) United States Patent
Asai et al.

(10) Patent No.: US 6,599,226 B2
(45) **Date of Patent: *Jul. 29, 2003**

(54) IMAGE FORMING SYSTEM

(75) Inventors: Hiroyuki Asai, Okazaki (JP); Yoichi Kawabuchi, Toyokawa (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 319 days.

(21) Appl. No.: 09/003,276

(22) Filed: Jan. 6, 1998

(65) Prior Publication Data

US 2002/0045524 A1 Apr. 18, 2002

(30) Foreign Application Priority Data

Jan. 7, 1997 (JP) ..... 9-000933

(51) Int. Cl.[7] ..... B41F 13/54

(52) U.S. Cl. ..... 493/321; 493/320; 493/385; 270/37; 270/88.08; 270/58.09

(58) Field of Search ..... 493/320, 321, 493/385; 270/32, 37, 58.08, 58.09

(56) References Cited

U.S. PATENT DOCUMENTS

| | | | | |
|---|---|---|---|---|
| 4,592,651 A | | 6/1986 | Oikawa et al. | 355/72 |
| 5,060,921 A | * | 10/1991 | Higashio et al. | 270/53 |
| 5,180,153 A | * | 1/1993 | Gegenheimer et al. | 270/58.14 |
| 5,257,081 A | | 10/1993 | Kato et al. | 355/324 |
| 5,382,011 A | * | 1/1995 | Tani | 270/37 |
| 5,769,404 A | * | 6/1998 | Kanou et al. | 270/37 |

FOREIGN PATENT DOCUMENTS

JP 05229727 A 9/1993

* cited by examiner

*Primary Examiner*—Eugene Kim
*Assistant Examiner*—Christopher Harmon
(74) *Attorney, Agent, or Firm*—Morrison & Foerster LLP

(57) ABSTRACT

An image forming system with a finisher connected to a copying machine via an inverting unit. The finisher has a stapling section which staples sheets stacked on a tray with a stapler and a folding section which folds a sheet with folding rollers. In a confidential mode, a sheet on which an image with confidential or private contents has been copied is transported to the finisher with its image-formed side facing down and is folded in two with the image inside. Then, in the stapling section, the folded sheet is stapled along a side opposite the fold.

15 Claims, 9 Drawing Sheets

1
7
8
9
10
11
12
15
16
17
19
20
21a
21b
22
23
24
25
26a
26b
30
31
32a
32b
33a
33b
34
35
40
41
42
43
44
45
46
51
52
53
54
61
62
63
64
65
66
67
68
69
71
72
73
74
75
76
77
78
79
80
81
82
83
83a
83b
84
85
85a
86
89
91
92
96
SE21
SE11
SE12
SE5
SE6
SE7
SE8
a
b
f

TWO-FOLD MODE

Z-FOLD MODE

FOLD-AND-UNFOLD MODE

CORNER STAPLE MODE

SIDE STAPLE MODE

CENTER STAPLE MODE

IMAGE FORMING SYSTEM

This application is based on application No. 9-933 filed Jan. 7, 1997 in Japan, the contents of which is hereby incorporated by reference.

BACKGROUND OF THE INVENTION

1. Field of the Invention

The present invention relates to an image forming system, and more particularly to an image forming system which forms an image on a sheet by an electrophotographic method and is capable of folding and stapling the sheet with an image thereon.

2. Description of Related Art

In the art of image forming apparatuses such as electrophotographic copying machines, laser printers and the like, recently, various types of devices which automatically handle sheets on which images have been formed, which are called finishers, have been developed. For example, Japanese Patent Laid Open Publication No. 4-320896 has disclosed an art of folding a copy of a cover in two, inserting copies of contents in the folded cover and stapling the set of copies near the fold.

Incidentally, when copies are to be confidential documents or to be a personal letter for protection of privacy, the images must be folded and closed inside. However, in conventional copying machines and finishers, copies are folded in two with the formed images outside and are stapled along the fold, and the purpose of protecting privacy cannot be achieved.

SUMMARY OF THE INVENTION

An object of the present invention is to provide an image forming system which is capable of automatically finishing copies as confidential documents or as a personal letter for protection of privacy.

In order to attain the object, an image forming system according to the present invention comprises: image forming means for forming an image on a sheet by an electrophotographic method; folding means which is capable of folding a sheet on which an image has been formed by the image forming means in two; stapling means for stapling a sheet on which an image has been formed by the image forming means; selecting means for selecting a confidential mode; and control means which, when the confidential mode is selected, controls the folding means and the stapling means to fold a sheet in two with the formed image inside and to staple the folded sheet along a side opposite the fold.

In the structure, when the confidential mode is selected, a sheet on which an image has been formed is folded with the image inside, and the folded sheet is stapled along a side opposite the fold. Thereby, the image is folded and closed inside, and the contents are not open. Thus, confidential or private matters can be concealed from others.

Further, by stamping a word such as "PERSONAL" "CONFIDENTIAL" or the like on the reverse side, it can be made clear that the sheet is confidential

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An exemplary image forming system according to the present invention is described with reference to the accompanying drawings.

General Structure

Figure 1:
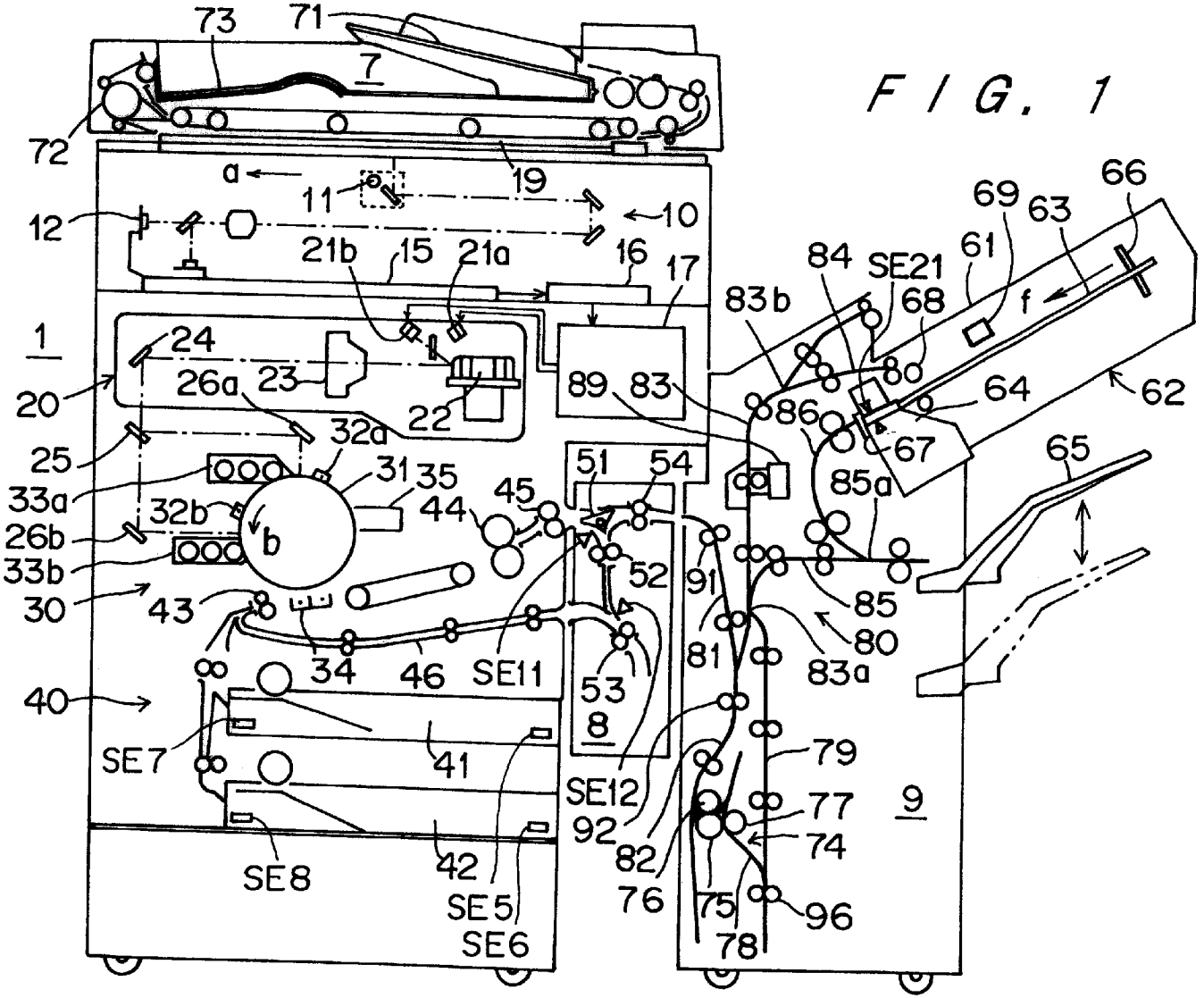
FIG. 1 is a sectional view which shows the internal structure of an image forming system according to the present invention.

FIG. 1 shows an image forming system according to the present invention. The image forming system is mainly composed of a copying machine 1, an automatic document feeder 7 mounted on the copying machine 1, an inverting unit 8 connected to a copy discharging section of the copying machine 1 and a finisher 9 which receives copies from the inverting unit 8 and carries out finishing such as folding, stapling, etc.

The automatic document feeder 7 feeds documents out of a tray 71 one by one onto a platen glass 19 and stops the fed document at a specified position on the platen glass 19. Then, after the document is subjected to image reading, the automatic document feeder 7 discharges the document from the platen glass 19 onto a discharge tray 73 through a discharge roller 72. Further, the automatic document feeder 7 is capable of inverting a duplex document so that both sides of the document can be subjected to image reading. Such operation of a document feeder is well known, and the description thereof is omitted.

Structure of the Copying Machine

The copying machine 1 has an image reading unit 10 and a laser optical unit 20 in its upper portion, an image forming section 30 in its middle portion, and a feed/transport section 40 in its lower portion.

The image reading unit 10 reads an image of a document set on the platen glass 19 with a CCD 12 while moving an exposure lamp 11 and mirrors in a direction indicated by arrow "a", and the structure and the operation of the image reading unit 10 are well known. The image data read by the CCD 12 are subjected to necessary processing in an image data processing section 15 and in a memory unit 16 and then transmitted to a print processing section 17. The memory unit 16 is selectively operated to transmit the image data for one page to the print processing section 17 immediately or to store the image data therein for later transmission when it is required. Further, in the memory unit 16, confidential mark data, such as some words like "CONFIDENTIAL", "PERSONAL", etc. and addresses, which are used in operation in a confidential mode are stored. These data are transmitted to the print processing section 17 at a specified time.

In the laser optical unit 20, laser beams are emitted from laser diodes 21*a* and 21*b* which are driven by a driver in the print processing section 17, and the laser beams are deflected by a polygon mirror 22. Then, the deflected beams are scanned on a photosensitive drum 31 through an fθ lens 23 and mirrors 24, 25, 26*a* and 26*b*, and thereby an image (latent image) is formed on the photosensitive drum 31. In this embodiment, the laser diode 21*a* is driven in accordance with red image data, and the laser beam emitted therefrom is directed to the photosensitive drum 31 by the mirror 26*a*. The laser diode 26*b* is driven in accordance with black image data, and the laser beam emitted therefrom is directed to the photosensitive drum 31 by the mirror 26*b*.

In the image forming section 30, around the photosensitive drum 31, which is driven to rotate in a direction indicated by arrow "b", there are provided a first electric charger 32*a*, a red developing device 33*a*, a second electric charger 32*b*, a black developing device 33*b*, a transfer charger 34, a residual toner cleaner 35, etc. are provided. These members for image formation are well known, and the descriptions of the structure and the image forming process are omitted.

The feed/transport section 40 feeds sheets one by one from either a cassette 41 or a cassette 42 to a pair of timing rollers 43. Further, the fed sheet is transported to a transfer position, where a toner image is transferred from the photosensitive drum 31 to the sheet. Thereafter, the toner image transferred onto the sheet is fixed thereon by a fuser 44, and the sheet is transported to the inverting unit 8 through a pair of discharge rollers 45. Further, in the feed/transport section 40, refeed path 46 is provided for the purpose of carrying out duplex copying, and a sheet which has obtained an image on its first side and been inverted in the inverting unit 8 can be transported to the timing rollers 43 again along the refeed path 46.

Inverting Unit

The inverting unit 8 has a diverter 51, a pair of transport rollers 52, a pair of inversion rollers 53 and a pair of discharge rollers 54. In a straight discharge mode, a sheet fed from the discharge rollers 45 of the copying machine 1 is guided by the upper surface of the diverter 51 which is set in a position shown by the solid line in FIG. 1 (first position) and transported straight to the finisher 9 through the discharge rollers 54.

In an inversion mode, the diverter 51 is rotated clockwise slightly to be set in a second position, so that a sheet fed from the copying machine 1 is guided by the left surface of the diverter 51 and transported downward by the transport rollers 52 and the inversion rollers 53. When the trailing edge of the sheet has passed the diverter 51 (when the trailing edge of the sheet is detected by a sensor SE11), the diverter 51 is rotated clockwise further to be set in a third position, and the transport rollers 52 and the inversion rollers 53 are rotated in reverse. Thereby, the sheet is guided by the right surface of the diverter 51 and transported to the finisher 9 through the discharge rollers 54, and at this time, the sheet is upside down and inside out.

In a refeed mode, a copy sheet fed from the copying machine 1 is transported downward by the transport rollers 52 and the inversion rollers 53 in the same manner as in the inversion mode. When the trailing edge of the sheet comes immediately before the inversion rollers 53 (when the trailing edge is detected by the sensor SE 12), the rotation of the inversion rollers 53 is switched to reverse. Thereby, the sheet is transported into the refeed path 46 upside down and inside out.

Finisher

The finisher 9 comprises a non-sort tray 61 on which sheets fed from the inverting unit 8 are stacked, a stapling section 62 which stacks sheets on a tray 63, takes the stacked sheets out of the tray 63 and staples the sheets with a stapler 64, a large-capacity tray 65 which is movable up and down, a folding section 74 and a transport section 80.

The transport section 80 comprises a transport path 81 which receives a sheet from the inverting unit 8 and transports the sheet downward, a switchback path 82 with a pair of rollers 92 which have the sheet make a switchback, a transport path 83 which transports the sheet after the switchback to the non-sort tray 61, a transport path 84 diverging from the transport path 83 at a point 83*b* and extending to the staple tray 63, a transport path 85 diverging from the transport path 83 at a point 83*a* and extending to the large-capacity tray 65, and a transport path 85 extending from the stapling tray 63 to a point 85*a* of the transport path 85 to transport a set of sheets stapled by the stapler 64 into the transport path 85. Further, a punching unit 89 is provided in the transport path 83.

Figure 2A:
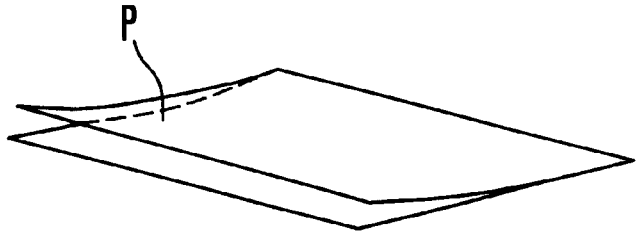
FIGS. 2*a*, 2*b* and 2*c* are illustrations which show available folding modes in the image forming system.
Figure 2B:
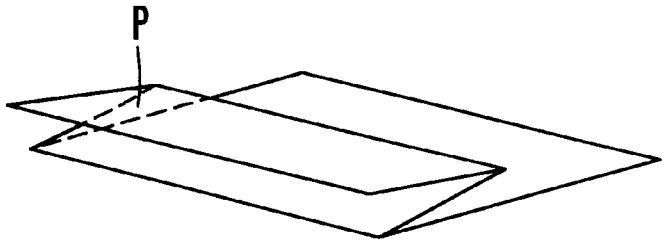
Figure 2C:
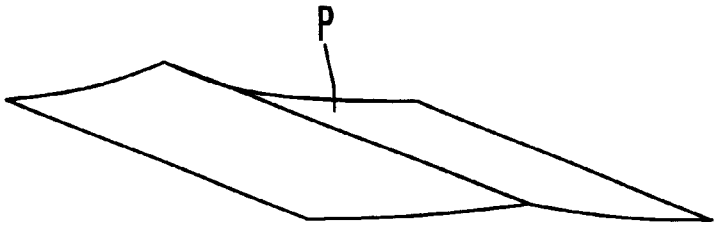

The folding section 74 has three folding rollers 75, 76 and 77. As shown in FIGS. 2*a*, 2*b* and 2*c*, the folding section 74 is operable in a two-fold mode of folding a sheet P in two at the center, a Z-fold mode of folding a sheet P in the shape of Z, a fold-and-unfold mode of folding a sheet P in two once and unfolding the sheet P, which is suitable for binding of a magazine. The folding operation by use of three rollers is well known, and the description thereof is omitted. A sheet which has been subjected to the folding process is transported downward in a transport path 78 to a vertical transport path 79, and the sheet makes a switchback and is transported upward in the vertical path 79 by a pair of rollers 96. Then, the sheet is transported to the point 83*a* of the transport path 83.

Figure 3A:
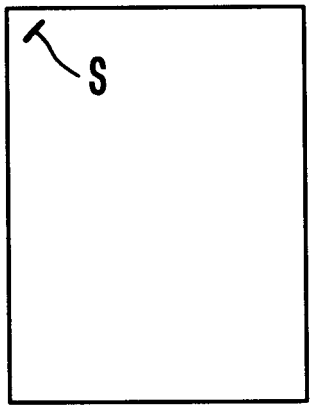
FIGS. 3*a*, 3*b* and 3*c* are illustrations which show available stapling modes in the image forming system.
Figure 3B:
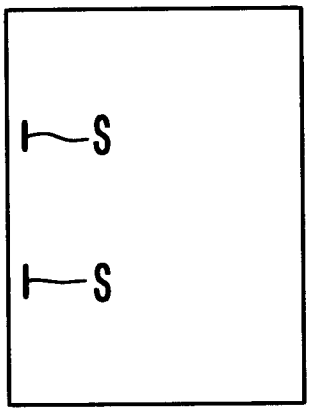
Figure 3C:
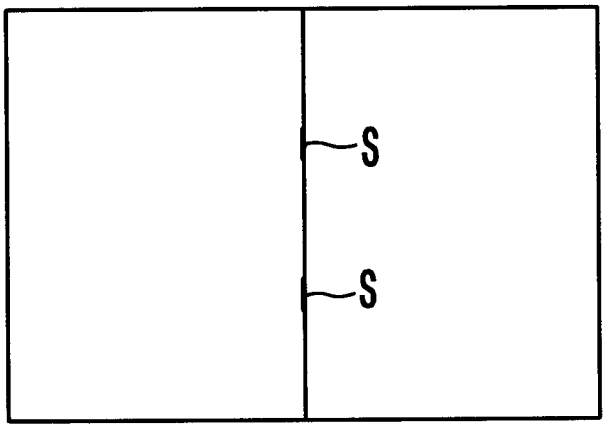

As shown in FIGS. 3*a*, 3*b* and 3*c*, the stapling section 62 is operable in a corner staple mode of striking a stack of sheets on the tray 63 with a staple S at a corner, in a side staple mode of striking a stack of sheets with staples S along a side, and in a center staple mode of striking a stack of sheets with staples S on the fold of the center. The stapling operation is well known, and the description thereof is omitted.

For the staple tray 63, an aligning stick 66, a stopper 67, a pair of take-out rollers 68 and a sensor SE21 are provided. The aligning stick 66 is movable forward and backward on the tray 63. The stopper 67 is located at a sheet take-out section of the tray 63 and is movable between a position to regulate sheets and a position to release sheets. Every time a sheet is transported onto the staple tray 63, the aligning stick 66 moves in a direction indicated by arrow "f" from a retreating position for alignment of sheets on the staple tray 63. In this moment, the stopper 67 is in the regulating position.

The take-out rollers 68 are usually in an upper and a lower positions respectively apart from each other. In order to take a stack of sheets out of the staple tray 63, the take-out rollers 68 nip the stack of sheets and provide a force to the stack of sheets. In this moment, the stopper 67 is retreated from the regulating position. The sensor SE21 is used in combination with a timer to detect the travel of the stack of sheets from the staple tray 63. The detected value is used to determine the time to staple the stack of sheets (stapling position) with the stapler 64.

Operation Panel

Figure 4:
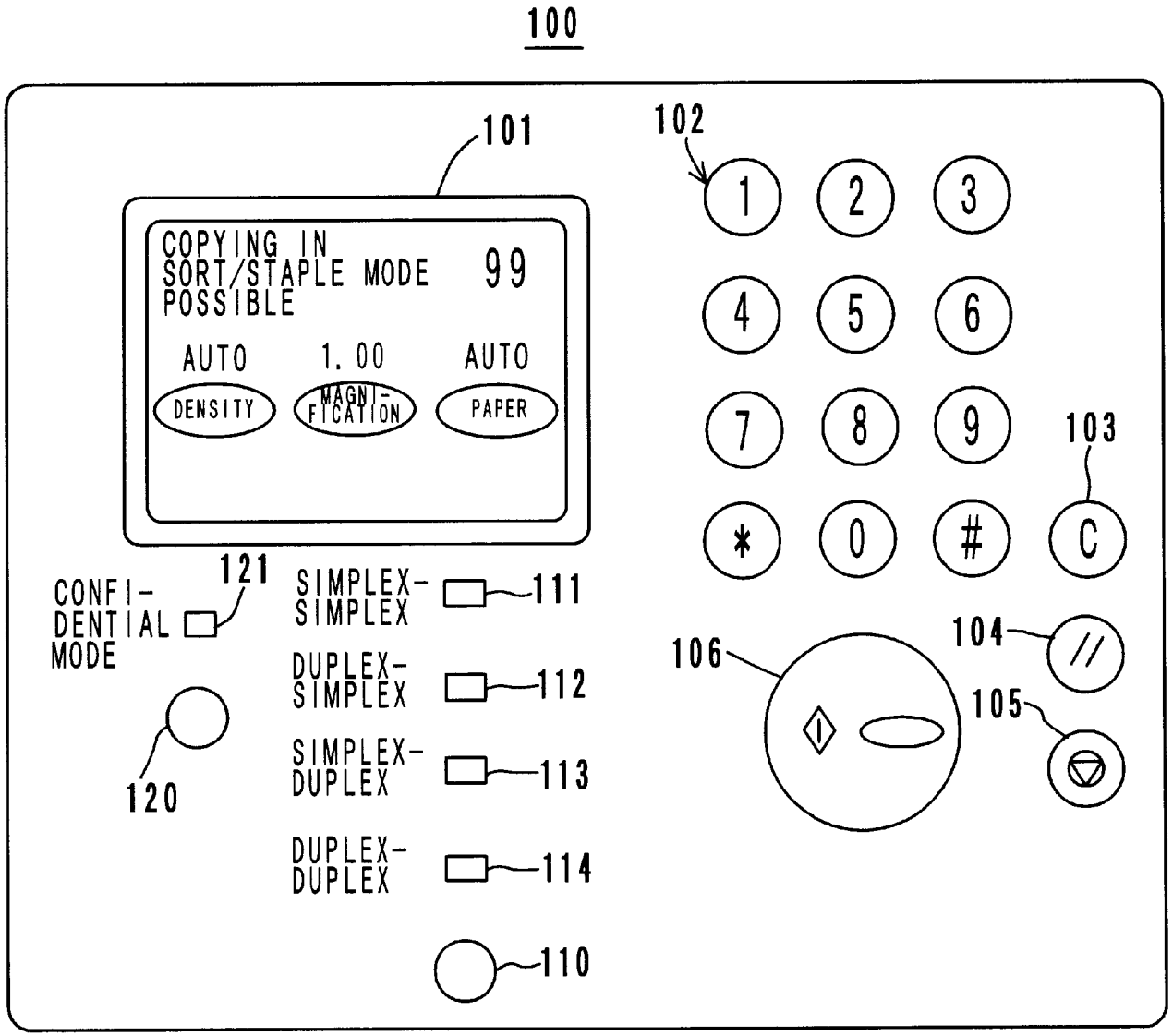
FIG. 4 is a plan view of an operation panel of the image forming system.

FIG. 4 shows an operation panel 100 disposed on the copying machine 1. On the operation panel 100, there are provided a liquid crystal touch panel 101, a ten-key 102 for inputs of the number of copies to be made and the copying magnification, a clear key 103 for resetting the input made with the ten-key 102, a reset key 104 for resetting the copy mode and the like to initial modes, a stop key 105 for discontinuing copying operation, a start key 106 for starting copying operation. Further, on the operation panel 100, a copy mode selection key 110 for setting a copy mode when using the automatic document feeder 7 and a confidential mode selection key 120 are provided. Initially, the copy mode is set to a simplex—simplex mode (a mode of making a simplex copy from a simplex document), and an LED 111 is turned on. Every time the copy mode selection key 110 is pressed, the copy mode is changed to a duplex-simplex mode (a mode of making simplex copies from a duplex document), to a simplex-duplex mode (a mode of making a duplex copy from simplex documents) and to a duplex—duplex mode (a mode of making a duplex copy from a duplex document) in order, and LEDs 112, 113 and 114 are turned on respectively in order. Initially, a confidential mode is not selected, and an LED 121 is turned off. Every time the confidential mode selection key 120 is pressed, the confidential mode is selected and reset repeatedly, and the LED 121 is turned on when it is selected.

Control Circuit

Figure 5:
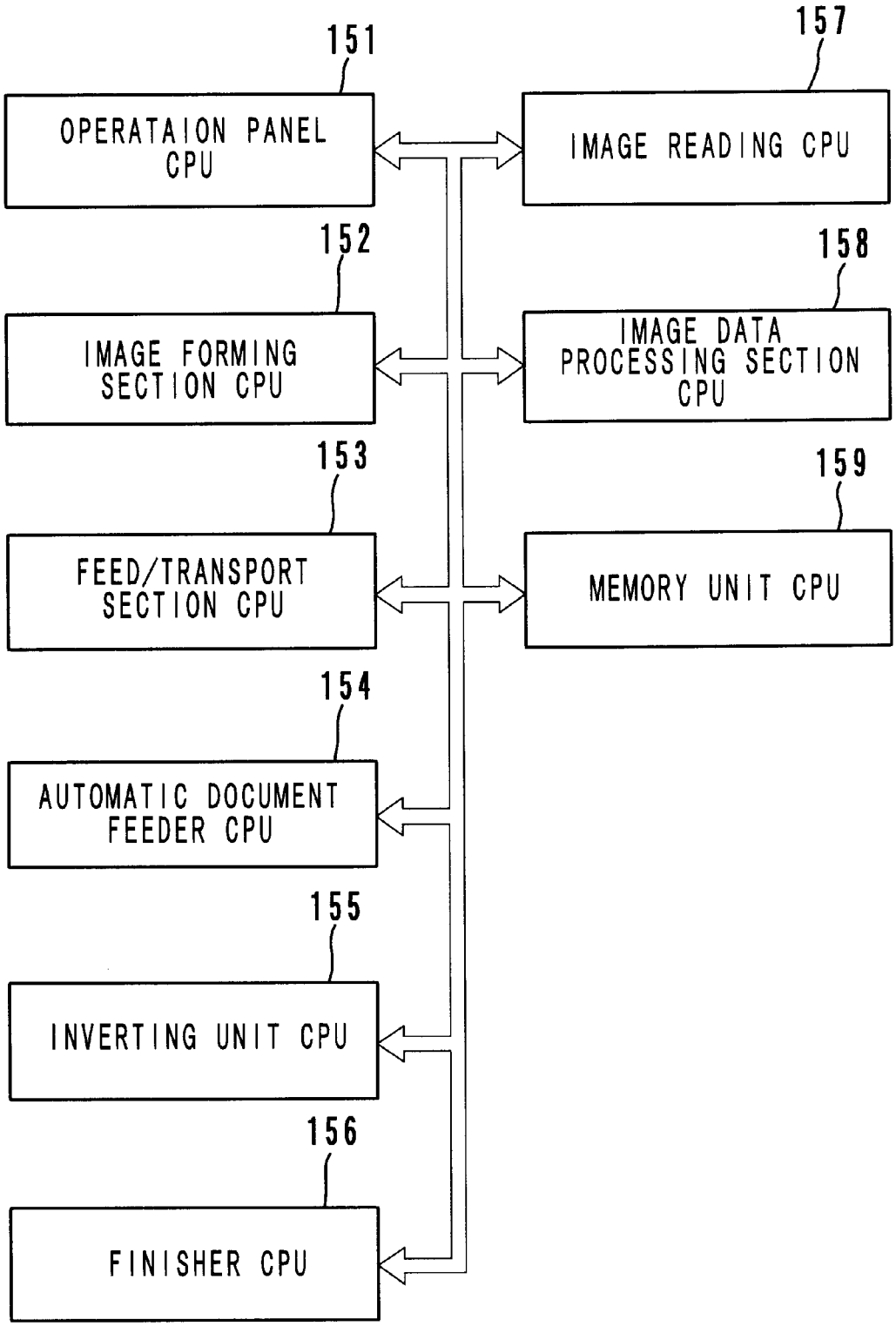
FIG. 5 is a block diagram of a control circuit of the image forming system.

FIG. 5 shows CPUs 151 through 159 which control various sections of the image forming system. Each of the CPUs 151 through 159 has a ROM stored with a necessary program and a RAM for storing parameters necessary to carry out the program.

The CPU 151 controls input signals sent from the keys on the operation panel 100 and display signals. The CPU 152 controls the image forming section 30, the laser optical unit 20 and the print processing section 17. The CPU 153 controls the feed/transport section 40. The CPU 154 controls the automatic document feeder 7, the CPU 155 controls the inverting unit 8, and the CPU 154 controls the finisher 9. The CPU 157 controls the image reading unit 10, the CPU 158 controls the image data processing section 15, and the CPU 159 controls the memory unit 16. These CPUs 151 through 159 carry out necessary processing while exchanging signals with one another.

First Example of the Confidential Mode

In the first example of the confidential mode, first, an image is copied on a first side of a sheet. The confidential copy is transported to the inverting unit 8 with the image-formed side (the first side) facing up. The copy is inverted by the transport rollers 52 and the inversion rollers 53 and is transported to the finisher 9 through the discharge rollers 54 with the image-formed side facing down. Then, the copy is transported to the folding section 74 through the transport path 81 and is folded in two by the folding rollers 75 and 76 with the image inside. The folded copy is transported downward in the transport paths 78 and 79 with the fold being the leading edge. Then, with reverse rotation of the rollers 96, the sheet makes a switchback to travel upward in the vertical transport path 79. Thereafter, the confidential copy is transported into the transport path 83 at the junction 83*a* and further into the transport path 84 at the diverging point 83*b*. Then, the confidential copy is transported onto the staple tray 63.

Second Example of the Confidential Mode

In the second example, on the reverse side of a confidential copy (which will be the face after being subjected to side stapling), a confidential mark such as "CONFIDENTIAL", "PERSONAL" or the like is printed. In the same manner as in the first example, an image is copied on a first side of a sheet, and the confidential copy is transported into the inverting unit 8. The copy is transported downward by the inversion rollers 53 until the sensor SE12 detects the trailing edge of the copy. When the sensor SE12 detects the trailing edge, the inversion rollers 53 are rotated in reverse, so that the copy is transported into the refeed path 46 upside down.

The confidential copy is fed to the timing rollers 43 again, and a confidential mark such as "CONFIDENTIAL", "PERSONAL" and/or an address is printed on a second side of the sheet. The data for such confidential marks are stored in the memory unit 16 and transmitted to the print processing section 17 when necessary. It may be possible to develop such a confidential mark with red toner.

The confidential copy which has obtained the confidential mark on the reverse side is transported to the inverting unit 8 again. At this time, the confidential copy is guided by the upper side of the diverter 51 and is transported to the finisher 9 straight. In the finisher 9, the copy is folded in two by the folding rollers 75 and 76 with the image (first side) inside. Thereby, the confidential mark comes on the face. Then, the confidential copy is transported to the stapling section 62, where the stapler 64 carries out side stapling toward the confidential copy. If a plurality of pages are to be a confidential copy set, the second and succeeding pages are transported to the staple tray 63 in the same manner as in the first example and subjected to side stapling.

Third Example of the Confidential Mode

In the third example, a stamping unit 69 is provided on the staple tray 63 to stamp a confidential mark such as "CONFIDENTIAL", "PERSONAL", etc. on the face of a confidential copy transported onto the tray 63. The transportation and the folding of a confidential copy in the inverting unit 8 and in the finisher 9 are carried out in the same way as in the first example. Further, the stamping unit 69 can be provided at any locations in the copy sheet transport paths as well as on the tray 63.

Control Procedure

Next, referring to FIGS. 6 through 9, the main part of the control procedure for carrying out the confidential mode is described. The control procedure described in the following paragraphs is to carry out the second example of the confidential mode. Further, in the following paragraphs, the term "on-edge" means a moment when a sensor or a key is turned on from off, and the term "off-edge" means a moment when a sensor or a key is turned off from on.

Figure 6:
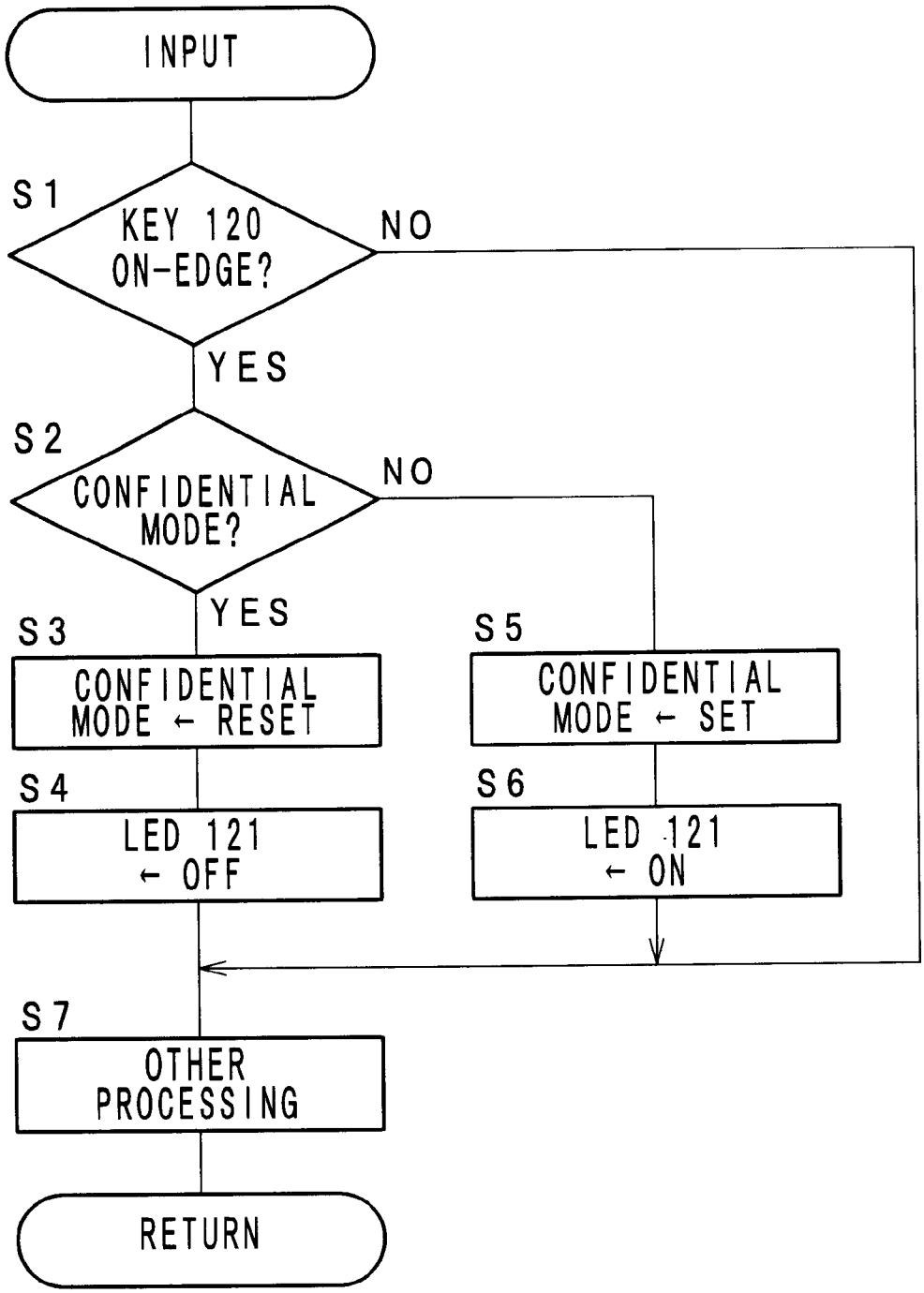
FIG. 6 is a flowchart which shows a control procedure for input.

FIG. 6 shows an input subroutine carried out by the CPU 151. First at step S1, the confidential selection key 120 is checked whether to be on-edge. If the key 120 is on-edge, it is judged at step S2 whether the confidential mode has been selected. If the confidential mode is currently set, the confidential mode is reset at step S3, and the LED 121 is turned off at step S4. On the other hand, if the confidential mode is currently reset, the confidential mode is set at step S5, and the LED 121 is turned on at step S6. Then, other input processing is carried out at step S7.

Figure 7:
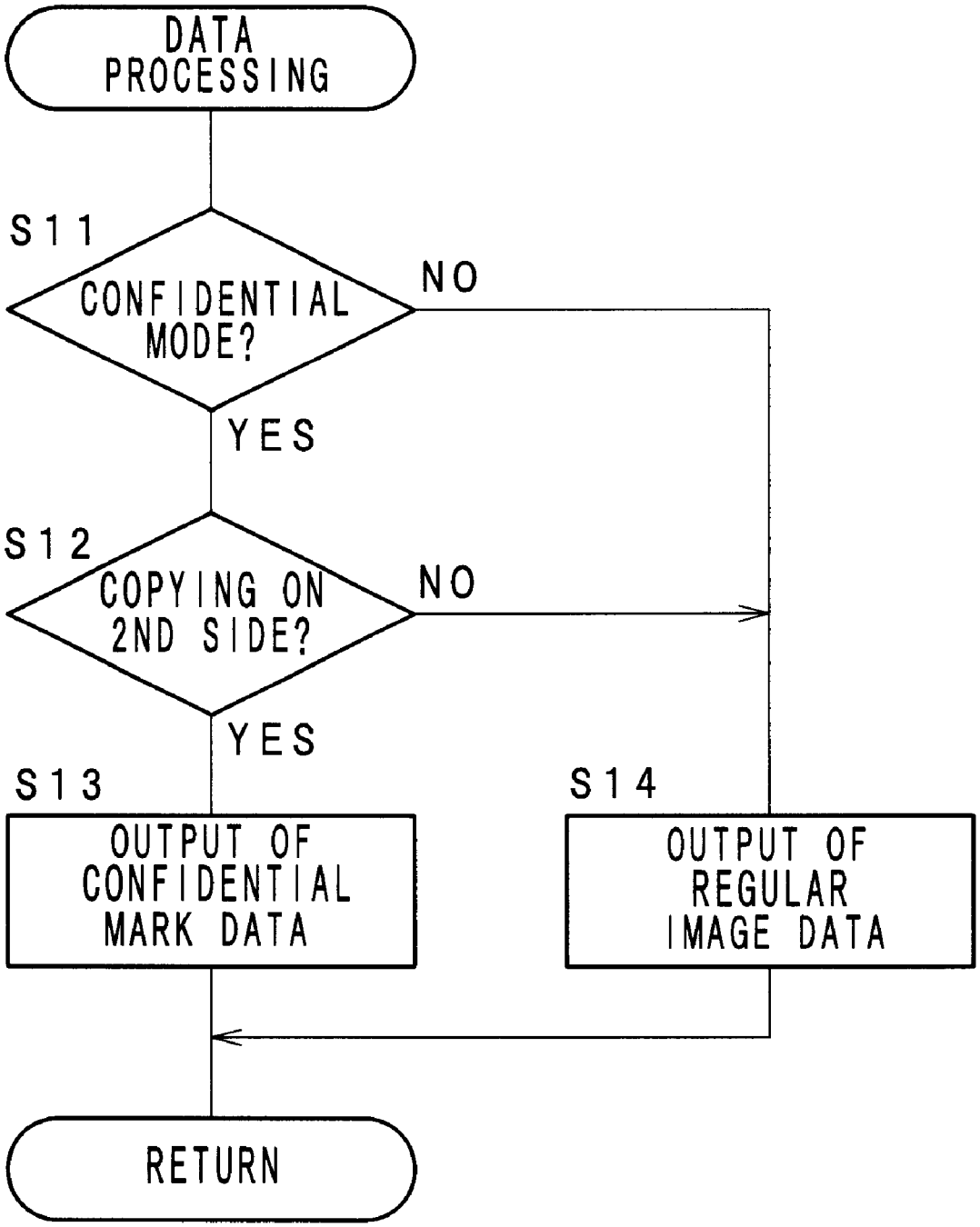
FIG. 7 is a flowchart which shows a control procedure for data processing.

FIG. 7 shows a data processing subroutine carried out by the CPU 159. First at step S11, it is judged whether the confidential mode is set. If not, the memory unit 16 outputs regular image data (image data about a document read by the image reading unit 10) to the print processing section 17. If the confidential mode is set, it is judged at step S12 whether copying is to be carried out on a second side of a sheet. If not, that is, when in the confidential mode, copying on a first side of a sheet is to be carried out, regular image data are outputted to the print processing section 17 at step S14. At this time, the memory unit 16 outputs image data about a document set on the platen glass 19. On the other hand, if copying on a second side of a sheet is to be carried out, the memory unit 16 outputs confidential mark data at step S13. This is the time when a sheet which has obtained the image of a confidential document on its first side is fed to the transfer section again through the refeed path 46 to obtain a confidential mark on the reverse (second) side.

Figure 8:
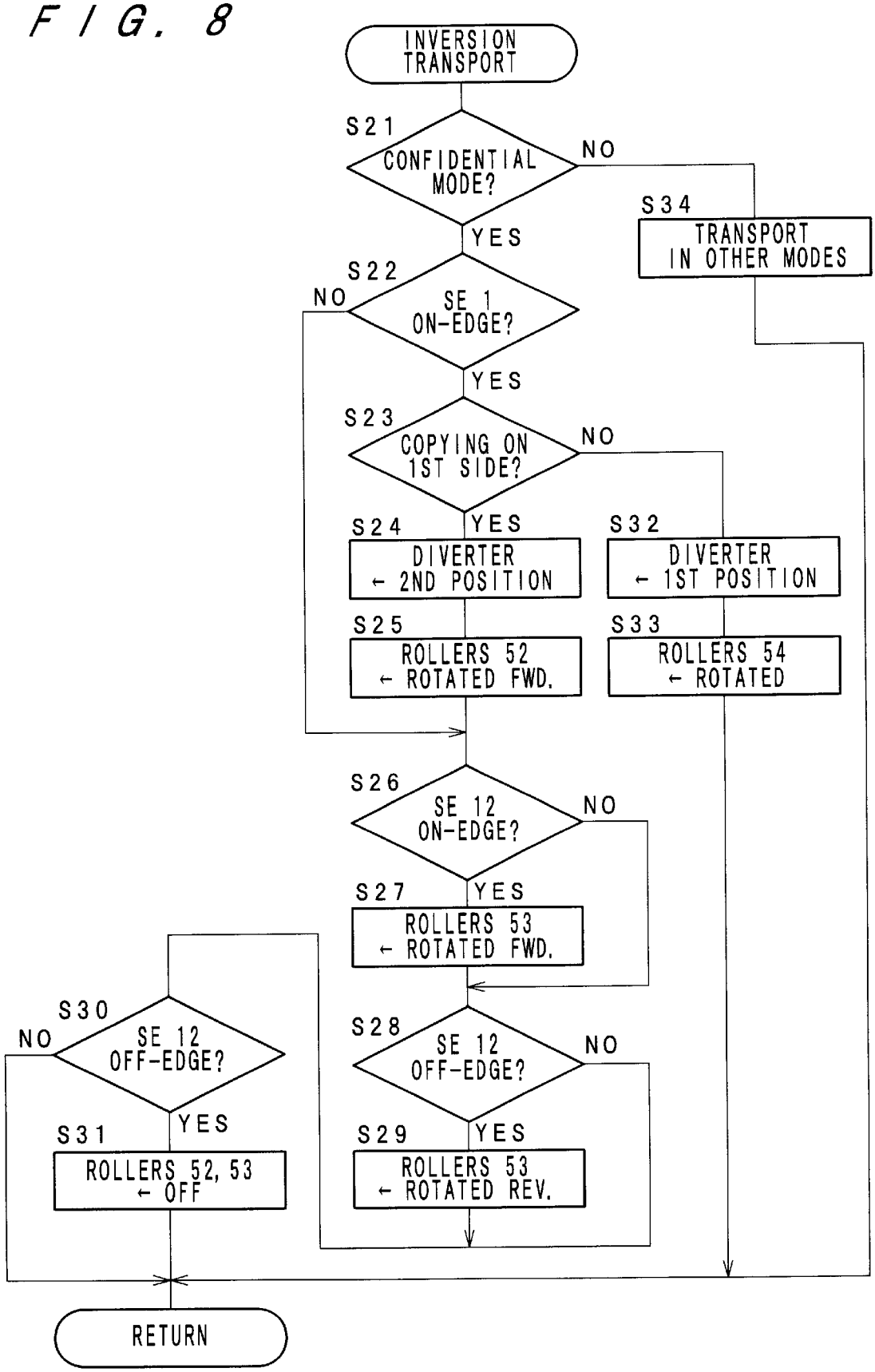
FIG. 8 is a flowchart which shows a control procedure for inversion transport.

FIG. 8 shows an inversion transport subroutine which is carried out by the CPU 155 to control the inverting unit 8. First at step S21, it is judged whether the confidential mode is set. If not, processing for transportation in other copy modes is carried out at step S34. If the confidential mode is set, at step S22, the sensor SE1 provided in the discharging section of the copying machine 1 is checked whether to be on-edge. If the sensor SE1 is on-edge, that is, when the leading edge of a confidential copy has reached the discharge rollers 45, it is judged at step S23 whether the current or just completed copying toward the sheet is/was on a first side. If it is on the first side, the diverter 51 is set in the second position at step S24, and the transport rollers 52 are rotated forward at step S25. Thereby, the confidential copy with an image on its first side is transported downward in the inverting unit 8.

Next, when an on-edge of the sensor SE12 is judged at step S26, that is, when the leading edge of the copy comes right before the inversion rollers 53, the inversion rollers 53 are rotated forward at step S27. Thereby, the copy is transported further downward. Then, when an off-edge of the sensor SE12 is judged at step S28, that is, when the trailing edge of the copy has passed the sensor SE12, the rotation of the inversion rollers 53 is switched to reverse. Thereby, the copy is fed into the refeed path 46, and at this moment, the copy is upside down. Subsequently, an off-edge of the sensor SE12 is judged at step S30, that is, when the trailing edge of the copy has passed the inversion rollers 53, the rollers 52 and 53 are turned off at step S31. Thereafter, the copy is fed to the transfer position again to obtain a confidential mark on the reverse (second) side.

On the other hand, if it is judged at step S23 that the current or just completed copying is/was on a second side of the sheet, the diverter 51 is set in the first position at step S32, and the discharge rollers 54 a rerotated at step 33. Thereby, the confidential copy which has obtained images on both sides is transported to the finisher 9 straight.

Figure 9:
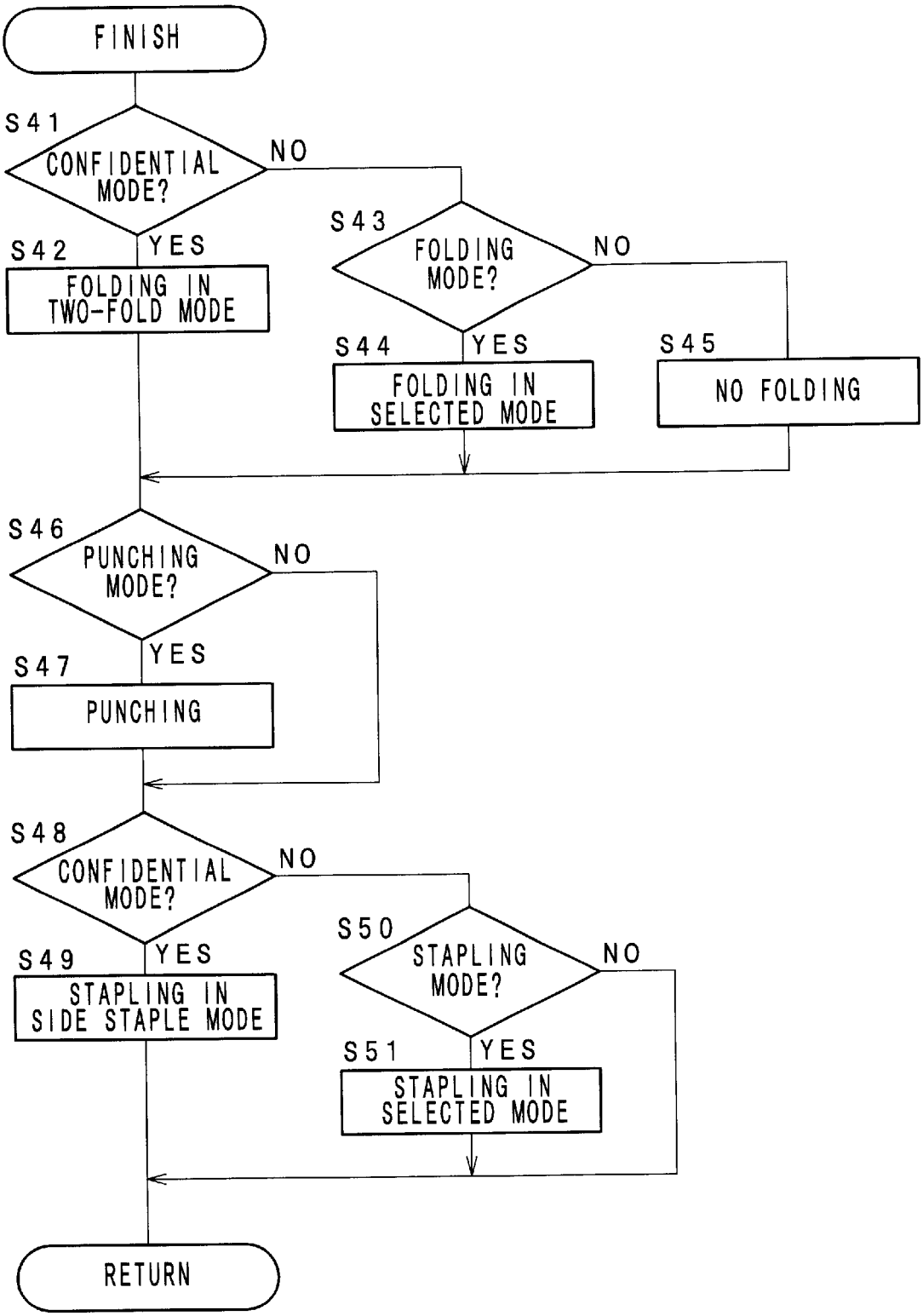
FIG. 9 is a flowchart which shows a control procedure for finishing.

FIG. 9 shows a finishing subroutine carried out by the CPU 156. First at step S41, it is judged whether the confidential mode is set. If the confidential mode is set, at step S42, a copy is transported to the folding section 74, where the copy is folded in two, and the folded copy is transported to the stapling section 62. If the confidential mode is not set, it is judged at step S42 whether a folding mode is set. If "YES" at step S43, at step S44, a copy is handled in a selected fold mode. If the folding mode is not set, at step S45, a copy is transported to either one of the trays 61, 63 and 65 without folding the copy.

Next, it is judged at step S46 whether a punching mode is set. If "YES" at step S46, at step S47, the punching unit 89 is operated to punch a copy.

Then, it is judged at step S48 whether the confidential mode is set. If the confidential mode is set, side stapling is carried out at step S49. If the confidential mode is not set, it is judged at step S50 whether a stapling mode is set. If "YES" at step S50, at step S51, a set of copies are stapled in a selected staple mode.

Although the present invention has been described in connection with the preferred embodiment above, it is to be noted that various changes and modifications are possible to those who are skilled in the art. Such changes and modifications are to be understood as being within the present invention.

What is claimed is:

1. An image forming system, comprising:

image forming means for forming an image on a sheet;

means for selecting a confidential mode to designate the image as confidential;

means for folding the sheet on which the image has been formed such that the image is inside the folded sheet when the image is designated as confidential; and stapling means for stapling the folded sheet along a side opposite the fold.

2. An image forming system as claimed in claim 1, wherein the image forming means forms an image by an electrophotographic method.

3. An image forming system as claimed in claim 1, further comprising control means for operating the stapling means when the confidential mode is selected.

4. An image forming system as claimed in claim 1, further comprising:

reverse side image forming means for forming an image on a reverse side of the sheet; and control means for operating the reverse side image forming means when the confidential mode is selected.

5. An image forming system as claimed in claim 4, wherein the forming of an image on the reverse side of the sheet by the reverse side image forming means identifies the image on the sheet as confidential.

6. An image forming system as claimed in claim 4, wherein the reverse side image forming means is a stamping unit for stamping specified letters.

7. An image forming system as claimed in claim 4, wherein the reverse side image forming means forms an image by an electrophotographic method.

8. An image forming system, comprising:

image forming means for forming an image on a sheet by an electrophotographic method;

means for selecting a confidential mode to designate the image confidential;

means for folding a sheet on which the image has been formed such that the image is inside the folded sheet when the image is designated as confidential;

stapling means for stapling a sheet on which an image has been formed by the image forming means; and control means for controlling the folding means and the stapling means to fold a sheet with the image inside and to staple the folded sheet along a side opposite the fold when the image to be formed is confidential.

9. An image forming system as claimed in claim 8, wherein, when the confidential mode is selected, the control means controls the image forming means to form a specified image on a reverse side of the sheet.

10. An image forming system as claimed in claim 9, wherein the forming of an image on the reverse side of the sheet identifies the image on the sheet as confidential.

11. An image forming system as claimed in claim 8, further comprising stamping means for stamping specified letters on a face of the folded sheet when the confidential mode is selected.

12. An image forming system, comprising:

image forming means for forming images on both sides of a sheet;

means for designating the image as confidential when a confidential mode has been selected; and means for folding the sheet on which the images have been formed with the image designated as confidential on an inside of the folded sheet.

13. An image forming system as claimed in claim 12, further comprising stapling means for stapling the folded sheet along a side opposite the fold.

14. An image forming system, comprising:

an image forming device forming images on both sides of a sheet;

a designating device designating the image as a confidential image when a confidential mode has been selected; and a folding device folding the sheet on which the images have been formed such that the confidential image is inside the folded sheet.

15. The image forming system of claim 14, wherein the sheet is marked after the image is designated confidential.

* * * * *